US008289259B2

(12) United States Patent
Hori

(10) Patent No.: US 8,289,259 B2
(45) Date of Patent: Oct. 16, 2012

(54) DISPLAY DEVICE AND SIGNAL DRIVER

(75) Inventor: Yoshihiko Hori, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 497 days.

(21) Appl. No.: 12/461,024

(22) Filed: Jul. 29, 2009

(65) Prior Publication Data

US 2010/0026618 A1 Feb. 4, 2010

(30) Foreign Application Priority Data

Aug. 1, 2008 (JP) ..... 2008-199784

(51) Int. Cl.
*G09G 3/36* (2006.01)

(52) U.S. Cl. ..... 345/99; 345/100; 345/204; 345/211; 345/213

(58) Field of Classification Search ..... 345/76–83, 345/204, 44–46, 99, 100, 211, 213; 40/571–607.15
See application file for complete search history.

(56) References Cited

U.S. PATENT DOCUMENTS 6,476,789 B1 * 11/2002 Sakaguchi et al. ..... 345/100
6,980,192 B1 * 12/2005 Matsumura et al. ..... 345/99
2002/0000954 A1 * 1/2002 Watabu ..... 345/60
2002/0030648 A1 * 3/2002 Yamamoto et al. ..... 345/87
2006/0284815 A1 * 12/2006 Kwon et al. ..... 345/98
2007/0070008 A1 * 3/2007 Shin et al. ..... 345/89
2007/0103421 A1 * 5/2007 Sekine et al. ..... 345/100
2007/0152947 A1 * 7/2007 Tanaka et al. ..... 345/100
2008/0238895 A1 * 10/2008 Lin et al. ..... 345/204

FOREIGN PATENT DOCUMENTS

JP 11-259050 A 9/1999
JP 2003-8424 A 1/2003

* cited by examiner

*Primary Examiner* — Lun-Yi Lao
*Assistant Examiner* — Priyank Shah
(74) *Attorney, Agent, or Firm* — McGinn IP Law Group, PLLC

(57) ABSTRACT

A display device includes a display portion; a signal driver; and a delay control circuit. The display portion is connected to a plurality of signal line groups. The signal driver is connected to the plurality of signal line groups and outputs a plurality of video data groups to the plurality of signal line groups at timings respectively in a single horizontal period. Each of the timings is shifted from an adjacent timing by a predetermined time. The delay control circuit varies the predetermined time every horizontal period and supplies the predetermined time to the signal driver.

18 Claims, 15 Drawing Sheets

DISPLAY DEVICE AND SIGNAL DRIVER

INCORPORATED BY REFERENCE

This application is based upon and claims the benefit of priority from Japanese patent application No. 2008-199784 filed on Aug. 1, 2008, the disclosure of which is incorporated herein in its entirety by reference.

BACKGROUND OF THE INVENTION

1. Field of the Invention

The present invention relates to a display device such as a TFT (Thin Film Transistor) liquid crystal display device, a simple matrix liquid crystal display device, an electroluminescence (EL) display device, or a plasma display device, and also to a signal driver of the display device.

2. Description of Related Art

Growth in size of a flat display device such as a liquid crystal television has raised growing demands for a higher-resolution display and a more smooth motion expression. To satisfy these demands, video data with broader bandwidth is required, thus promoting clock speed-up for the display device. However, the clock speed up, an effect of the growth in the size of the display device on power, and an effect of deteriorated ground impedance have caused concern about EMI (Electromagnetic Interference).

Referring to FIGS. 1 and 2, an effect of the EMI will be described.

Typically, a D-A converter 16 in a signal driver 101 has a high output impedance and cannot directly drive a display panel 3. That is, the D-A converter 16 has a low output current capability. Thus, an output amplifier circuit 17 (output buffer) with a high output current capability is used as an output circuit of the signal driver 101. As a result, the signal driver 101, via the output amplifier circuit 17, can output video data (output voltages) to signal lines. However, due to the high output current capability of the output amplifier circuit 17, when a level of a signal indicating video data is inverted from high to low or from low to high, transient currents (peak currents) instantaneously flow into signal lines. Due to the simultaneous inversions of the signals indicating the video data, the simultaneous flows of the peak currents into the signal lines causes large noise. This noise needs to be reduced.

Known as a technique related to the reduction of EMI is a "Liquid crystal display device driving method and driving device" described in Japanese Laid-Open Patent Application JP-A-Heisei 11-259050 (corresponding to U.S. Pat. No. 6,980,192B1). In the technique described in this application, noise generated when display data is transferred from a timing controller 4 to source drivers (signal drivers 101) is reduced. To achieve this, n delay circuits are provided in the timing controller 4, wherein the n delay circuits output n pieces of display data to the n signal drivers 101 at timings respectively, each timing is shifted from the previous timing by a predetermined time interval.

Also known as the technique related to the reduction of EMI is a "Noise reduction circuit of semiconductor device" described in Japanese Laid-Open Patent Application JP-P2003-008424A. In the technique described in this application, the semiconductor device is used as a liquid crystal display data control circuit (signal drivers 101 above), reducing noise generated when outputs of the signal drivers 101 are transferred. To achieve this, noise reduction circuits as delay circuits are provided in the signal drivers 101, wherein the noise reduction circuits output their outputs at timings respectively, each timing is shifted from the adjacent timing by a predetermined time interval.

We have now discovered the following facts. As described above, in the technique described in JP-A-Heisei 11-259050, as the transfer of the display data from the timing controller 4 to the signal drivers 101, the n delay circuits in the timing controller 4 output the n pieces of display data to the n signal drivers 101 at timings respectively, each timing is shifted from the adjacent timing by a predetermined time interval. However, in a recent display device, using a small amplitude differential signal based on the aforementioned LVDS (low voltage differential signaling) has become more common in the data transfer from the timing controller 4 to the signal drivers 101. With such a data transfer method, an output buffer in the timing controller 4 operates at constant current, and thus an excessive peak current is not generated in a current consumed at the output buffer. That is, then delay circuits in the timing controller 4 do not have to output the n pieces of display data to the n signal drivers 101 at timings respectively, each timing is shifted from the adjacent timing by a predetermined time interval. Thus, the technique described in JP-A-Heisei 11-259050 fails to handle excessive current and the reduction of EMI in the recent display devices.

Moreover, in the technique described in JP-A-Heisei 11-259050, as a delay time, time shorter than a video data transfer clock is required. In the case where the small amplitude differential signal based on the LVDS is adopted between the timing controller 4 and the signal drivers 101, the timing controller 4 usually serializes the video data as the display data and outputs it to the signal drivers 101. Thus, a frequency of the output from the timing controller 4 is several hundreds mega hertz, which is very high. A delay control with this high frequency is assumed to lead to cost increase (for the purpose of high accuracy and widening an adjustment range, timing generation by use of PLL (Phase Locked Loop) or the like is required) or is assumed to result in failure to sufficiently reduce the peak current due to a narrow adjustment range.

As described above, in the technique described in JP-P2003-008424A, the semiconductor device is used as the signal driver 101, and as the transfer of the outputs of the signal drivers 101, the noise reduction circuits in the signal drivers 101 output their outputs at timings respectively, each timing is shifted from the adjacent timing by a predetermined time interval. However, no clear description is provided concerning what the outputs of the noise reduction circuits are, what are output destinations of the noise reduction circuits, and between what the noise reduction circuits are connected. Thus, it is difficult to fully review the technique described in JP-P2003-8424A but there is still room for further improvement of this technique.

Thus, the noise generated when the signal drivers 101 transfer the video data to the display panel 3 is desired to be kept lower than conventional one.

SUMMARY

The present invention seeks to solve one or more of the above problems, or to improve upon those problems at least in part.

In one embodiment, a display device includes: a display portion configured to be connected to a plurality of signal line groups; a signal driver configured to be connected to the plurality of signal line groups and output a plurality of video data groups to the plurality of signal line groups at timings respectively in a single horizontal period, each of the timings is shifted from an adjacent timing by a predetermined time; and a delay control circuit configured to vary the predetermined time every horizontal period and supply the predetermined time to the signal driver.

In another embodiment, a signal driver, which is applied to a display portion connected to a plurality of signal line groups in a display device, includes: a delay circuit configured to output a plurality of video data groups at timings respectively in a single horizontal period, each of the timings is shifted from an adjacent timing by a predetermined time; and a drive circuit configured to output the plurality of video data groups from the delay circuit to the plurality of signal line groups respectively in the single horizontal period, wherein the predetermined time is varied every horizontal period.

In another embodiment, a display method, which is applied to a display device including a signal driver and a display portion, connected to a plurality of signal line groups, includes: a signal driver outputting a plurality of video data groups to the plurality of signal line groups at timings respectively in a single horizontal period, each of the timings is shifted from an adjacent timing by a predetermined time; and varying the predetermined time every horizontal period to supply the predetermined time to the signal driver.

A display device of the present invention outputs the video data in a single horizontal period to the signal lines at timings respectively, each timing is shifted from the adjacent timing by the predetermined time. At this time, varying the predetermined time every horizontal period permits keeping the noise, which is generated when the signal drivers transfer the video data to the display panel, lower than conventional one.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Hereinafter, referring to the accompanied drawings, a display device according to an embodiment of the present invention will be described in detail.

Figure 1:
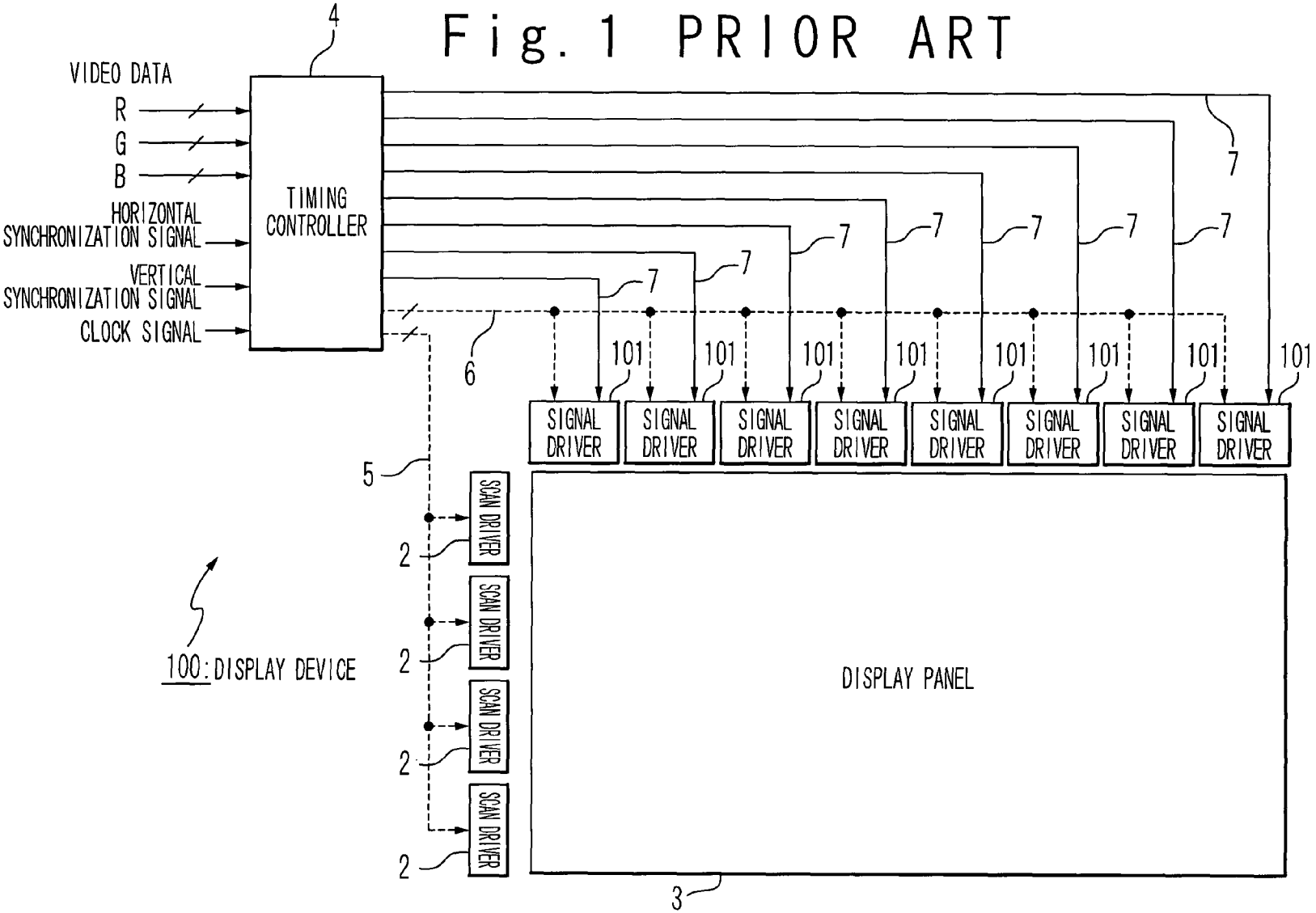
Fig. 1 PRIOR ART
FIG. 1 is a view showing a configuration of a general display device 100.
Figure 2:
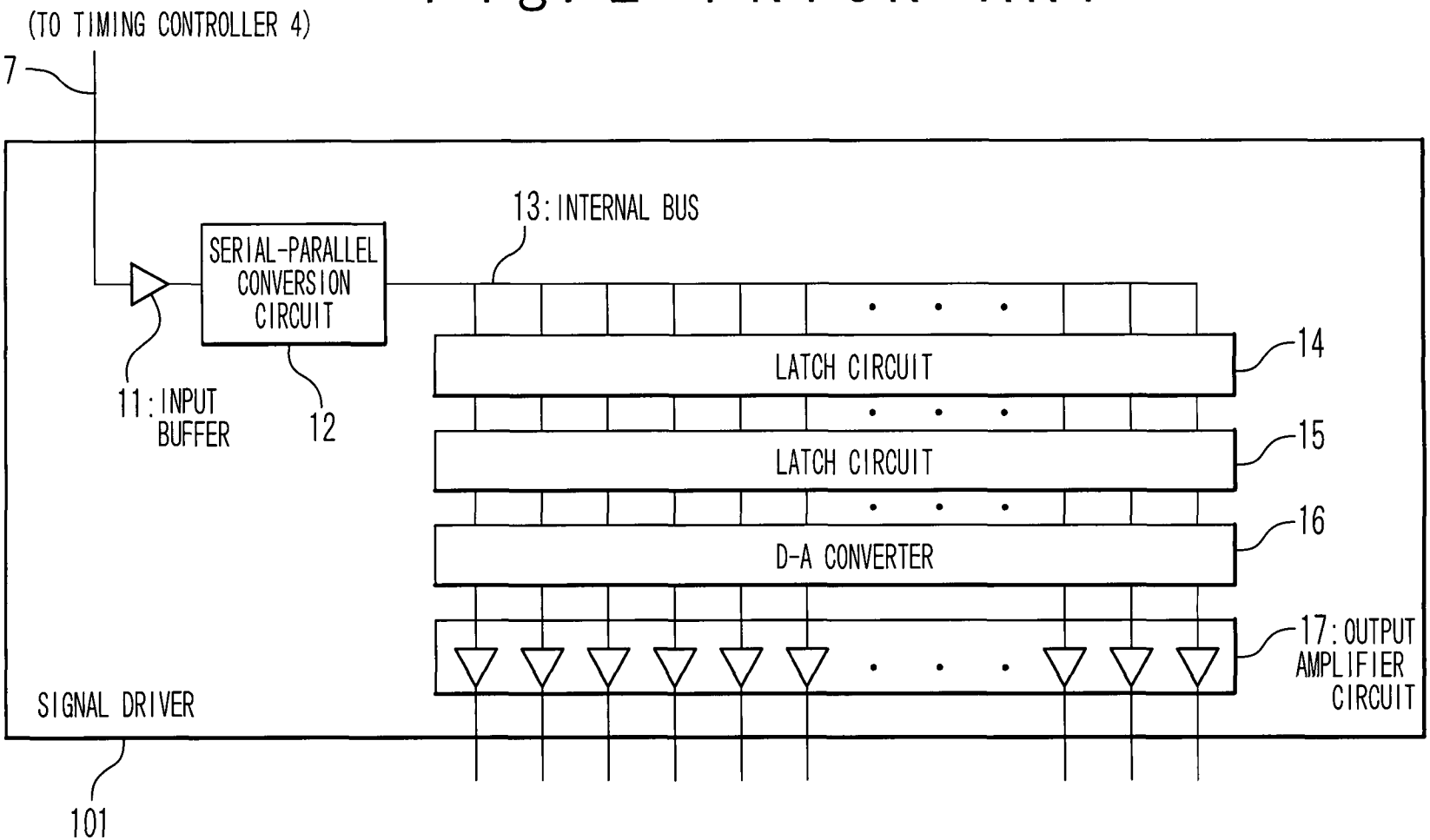
Fig. 2 PRIOR ART
FIG. 2 is a view showing a configuration of a signal driver 101 of FIG. 1.
Figure 3:
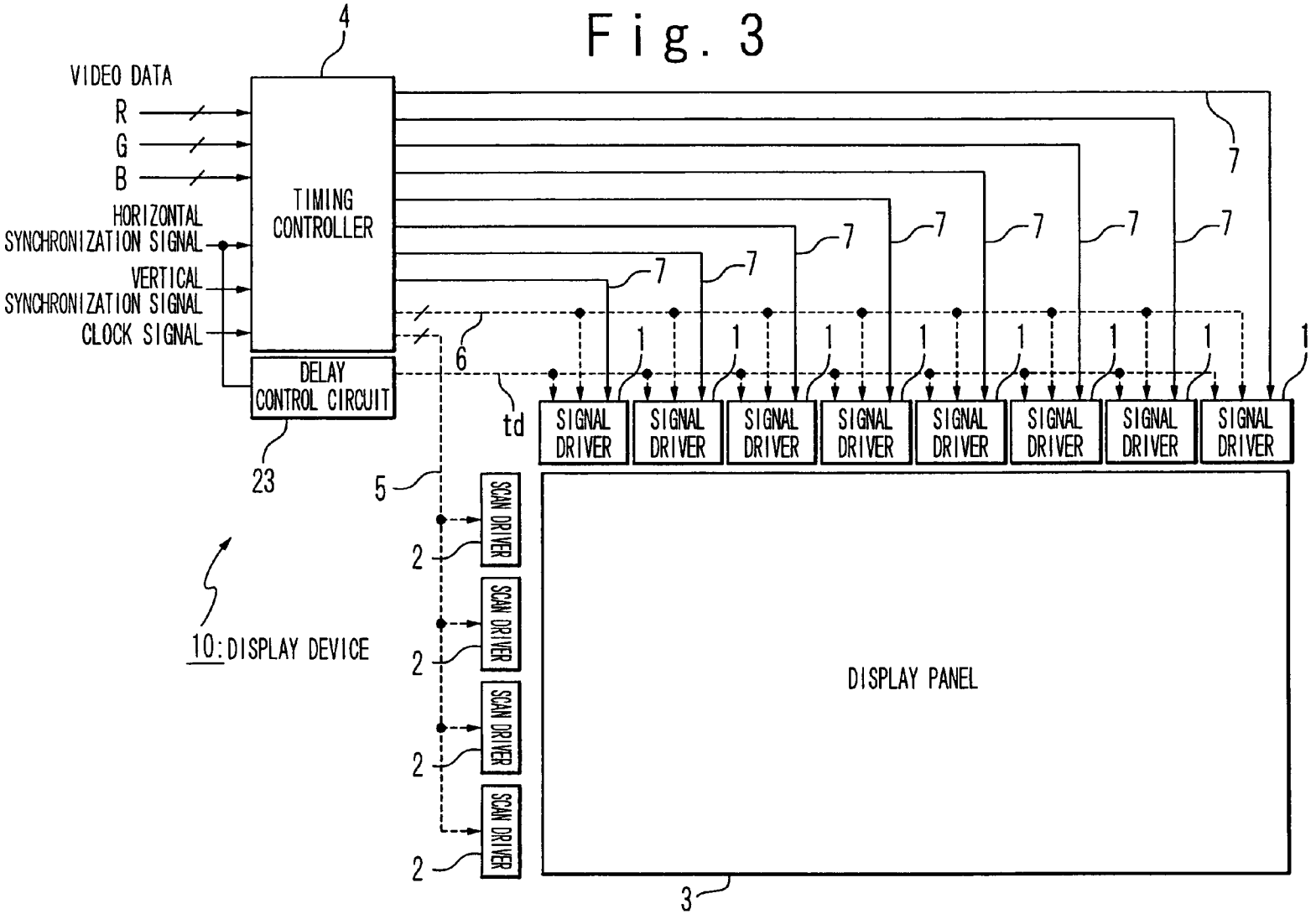
FIG. 3 is a view showing a configuration of a display device 10 according to an embodiment of the present invention.

FIG. 3 is a view showing a configuration of the display device 10 according to an embodiment of the present invention. The display device 10 according to the embodiment of the present invention includes n (where n is an integer of 2 or more) signal drivers 1, m (where m is an integer of 2 or more) scan drivers 2, a display panel (display portion) 3, a timing controller 4, and a delay control circuit 23.

The display panel 3 has a plurality of pixels (not shown) arranged in a matrix form. A plurality of scan lines (not shown) is arranged in a row direction in parallel, and a plurality of signal lines (not shown) is arranged in a column direction in parallel. The plurality of pixels is arranged at positions corresponding to intersections between the plurality of scan lines and the plurality of signal lines. Each pixel is connected to corresponding one scan line and signal line. The plurality of scan lines is divided into m scan line groups. The m scan line groups are respectively connected to the m scan drivers 2. The plurality of signal lines is divided into n signal line groups. The n signal line groups are respectively connected to then signal drivers 1. The timing controller 4 is connected to the n signal drivers 1 respectively via n data lines 7. The timing controller 4 is also connected to the m scan drivers 2 via a control line 5 and to the n signal drivers 1 via a control line 6. The delay control circuit 23 is connected to the n signal drivers 1 via a control line (not shown).

The timing controller 4 in parallel receives video data including data which express red, green, and blue and timing signals indicating a horizontal synchronization signal, a vertical synchronization signal, and a clock signal. The timing controller 4, based on the timing signals, generates a scan driver control signal for controlling the m scan drivers 2 and a signal driver control signal for controlling the n signal drivers 1. The timing controller 4 also performs processing such as video data rearrangement, timing adjustment, and bit count conversion based on configurations of the n signal drivers 1.

The timing controller 4 transmits the scan driver control signal to the m scan drivers 2 via the control line 5. Each of the m scan drivers 2 drives the scan line in response to the scan driver control signal.

In addition, the timing controller 4 transmits the signal driver control signal to the n signal drivers 1 via the control line 6, and also transmits display data obtained by serializing the video data, to the n signal drivers 1 respectively via the n data lines 7. For data transfer of the display data between the timing controller 4 and each of the n signal drivers 1, a small amplitude differential signal based on the LVDS is used. Each of the n signal drivers 1 drives the signal line based on the signal driver control signal and the display data.

The delay control circuit 23 receives the horizontal synchronization signal. The delay control circuit 23, in response to this horizontal synchronization signal, outputs a signal indicating predetermined time td to the n signal drivers 1. The delay control circuit 23 varies the predetermined time td every horizontal period and notifies it to the n signal drivers 1.

Figure 4:
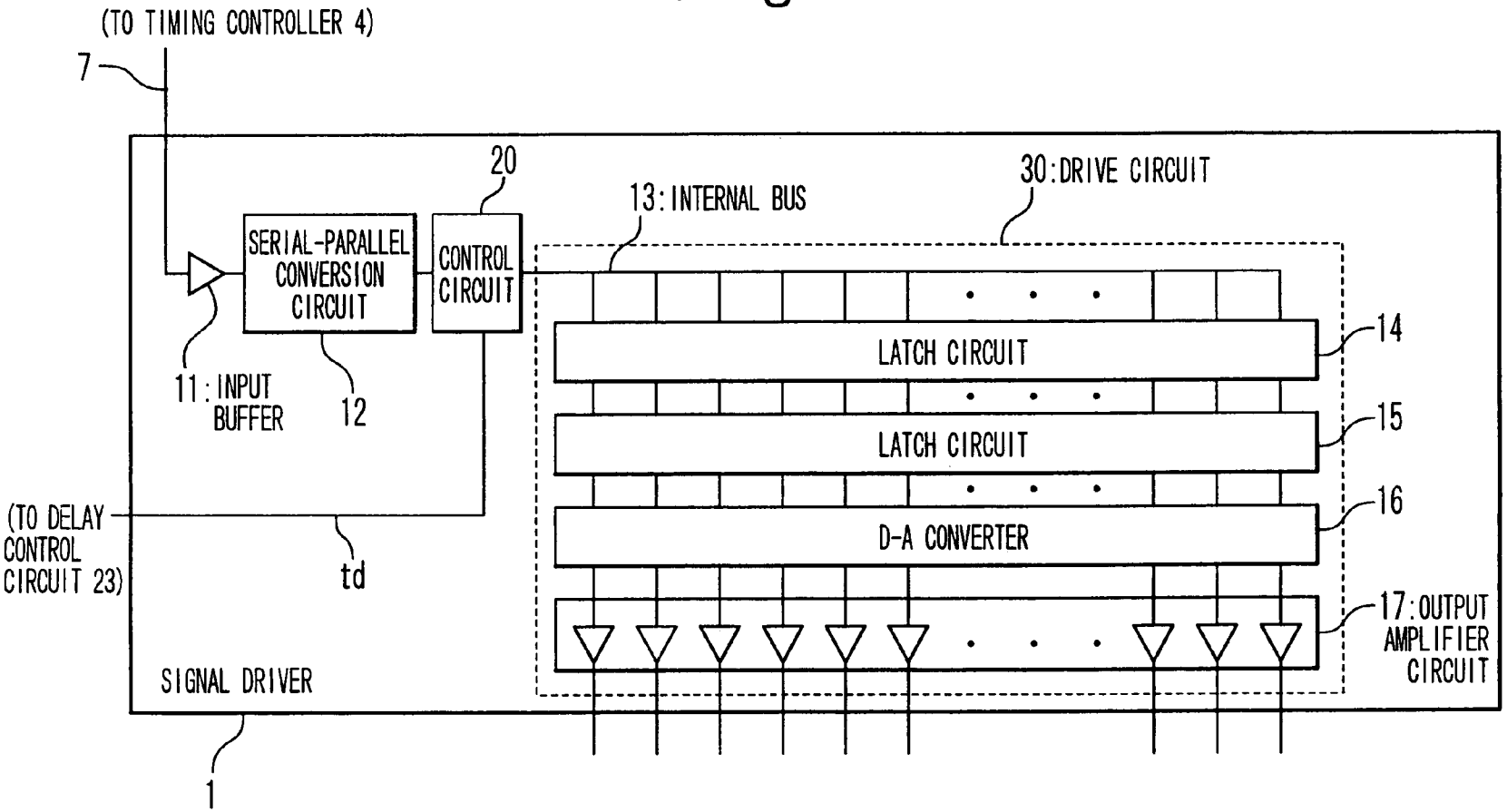
FIG. 4 is a view showing a configuration of a signal driver 1 of FIG. 3.

FIG. 4 is a view showing a configuration of the signal driver 1 of FIG. 3. The signal driver 1 includes an input buffer 11, a serial-parallel conversion circuit 12, a control circuit 20, and a drive circuit 30.

The input buffer 11 receives the display data from the timing controller 4. The serial-parallel conversion circuit 12 performs serial-parallel conversion on the display data and outputs the video data to the control circuit 20. The control circuit 20 receives the video data from the serial-parallel conversion circuit 12 and the signal indicating the predetermined time td from the delay control circuit 23. The control circuit 20 outputs the video data in a single horizontal period to the drive circuit 30. Specifically, the control circuit 20 sorts or divides the video data into video data groups (a plurality of video data groups) as described later, and outputs the video data groups at timings respectively, each timing is shifted from adjacent one (adjacent timing) by the predetermined time td. That is, the control circuit 20 outputs the video data groups respectively at intervals of the predetermined time td.

The drive circuit 30 includes an internal bus 13, a first latch circuit 14, a second latch circuit 15, a digital-analog (D-A) converter 16, and an output amplifier circuit 17.

The video data groups from the control circuit 20 are outputted to the first latch circuit 14 via the internal bus 13. The first latch circuit 14 stores (latches) the video data groups and outputs the video data groups to the second latch circuit 15 in response to the signal driver control signal. The second latch circuit 15, in a single horizontal period, stores (latches) the video data groups from the first latch circuit 14, and outputs the video data groups to the D-A converter 16 in response to the signal driver control signal. The D-A converter 16 performs digital-analog conversion on the video data groups from the second latch circuit 15 and outputs output voltage groups corresponding to the video data groups. Here, the output voltages output by the D-A converter 16 is considered to be sorted or divided into the output voltage groups (the plurality of output voltage groups) corresponding to the video data groups (the plurality of video data groups) as described later. The output amplifier circuit 17 outputs the output voltage groups to the signal lines, respectively.

Figure 5:
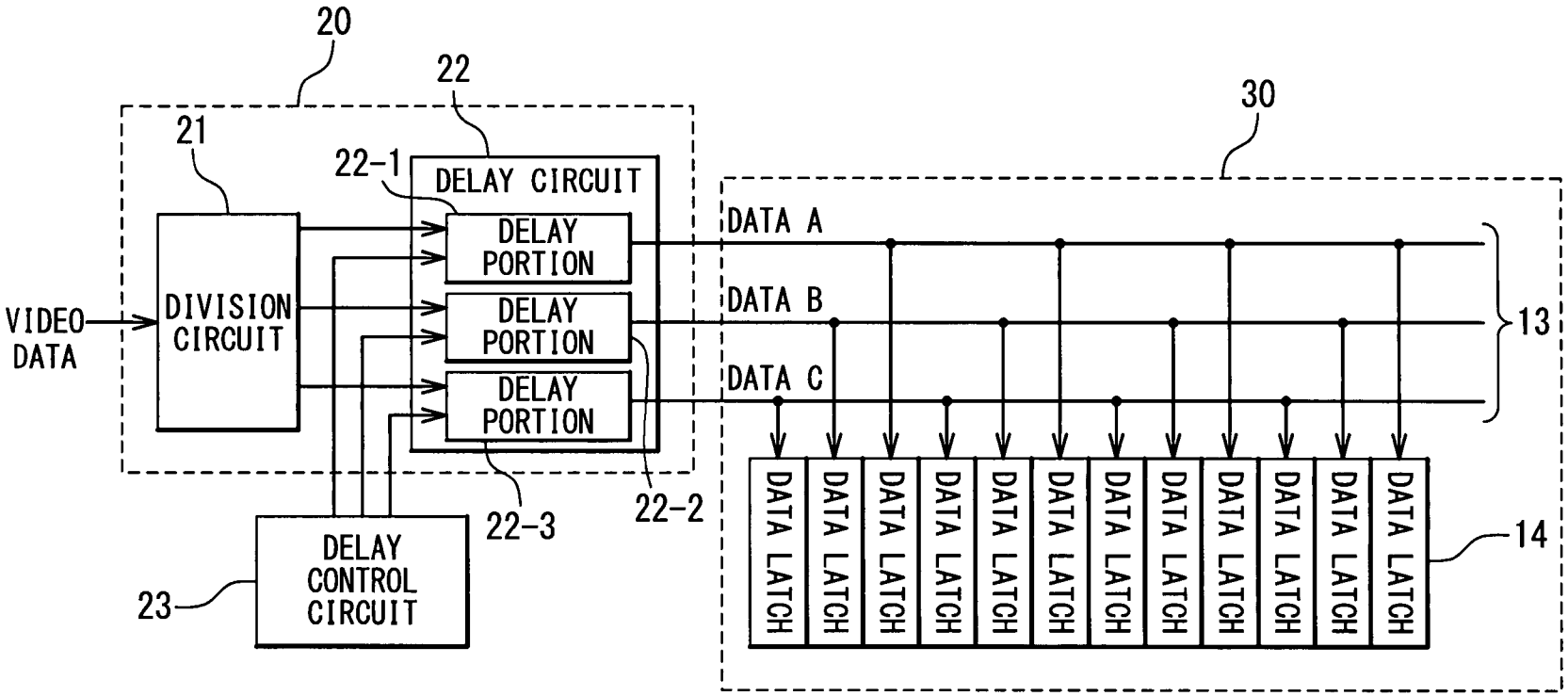
FIG. 5 is a view showing a configuration of a control circuit 20 of FIG. 4.

FIG. 5 is a view showing a configuration of the control circuit 20 of FIG. 4. The control circuit 20 includes a division circuit 21 and a delay circuit 22. The delay circuit 22 includes an N delay portions 22-1 to 22-N (where N is an integer of 2 or more satisfying n>N).

The signal lines are sorted or divided into N groups and connected to the display panel 3 and the signal drivers 1 as N sorted signal line groups. The division circuit 21 sorts the video data in a single horizontal period into N groups to thereby generate N sorted video data groups (the plurality of video data group as mentioned above). The delay portions 22-1 to 22-N of the delay circuit 22 receive the first to N-th sorted video data groups (N sorted video data groups) from the division circuit 21, respectively. The delay portions 22-1 to 22-N also receive a signal which indicates the predetermined time td transmitted from the delay control circuit 23. The delay portions 22-1 to 22-N, in a single horizontal period, output the first to N-th sorted video data groups to the drive circuit 30 at timings respectively, each timings is shifted from adjacent one (adjacent timing) by the predetermined time td. That is, the delay portions 22-1 to 22-N output the first to N-th sorted video data groups respectively at intervals of the predetermined time td. In this case, the drive circuit 30, in a single horizontal period, outputs the N sorted video data groups from the delay portions 22-1 to 22-N to the N sorted signal line groups, respectively.

Next, an operation performed by the control circuit 20 of the signal driver 1 of the display device 10 according to an embodiment of the present invention will be descried.

In the present embodiment, the video data is sorted into the N groups (N sorted video data groups). At this time, for example, N is 3, of the three (3) video data groups, the sorted video data group including red data can be defined as the first group (the first video data group), the sorted video data group including green data can be defined as the second group (the second video data group), and the sorted video data group including blue data can be defined as the third group (the third video data group). In the present embodiment, for simplified description, N is 3 and the video data groups represent Di [0] to Di [5]. Here, "i" corresponds to a single horizontal period and is expressed by 0, 1, 2, 3, . . . . In this case, the first group (the first video data group) includes Di [4] and Di [5] as two-bit sorted video data group A, the second group (the second video data group) includes Di [3] and Di [2] as two-bit sorted video data group B, and the third group (the third video data group) includes Di [1] and Di [0] as two-bit sorted video data group C (see FIG. 6A). In this case, the aforementioned signal lines are sorted into three groups and they are connected to the display panel 3 and the signal drivers 1 as the first sorted signal line group corresponding to the first group, the second sorted signal line group corresponding to the second group, and the third sorted signal line group corresponding to the third group.

(Processing 0)

Figure 6A:
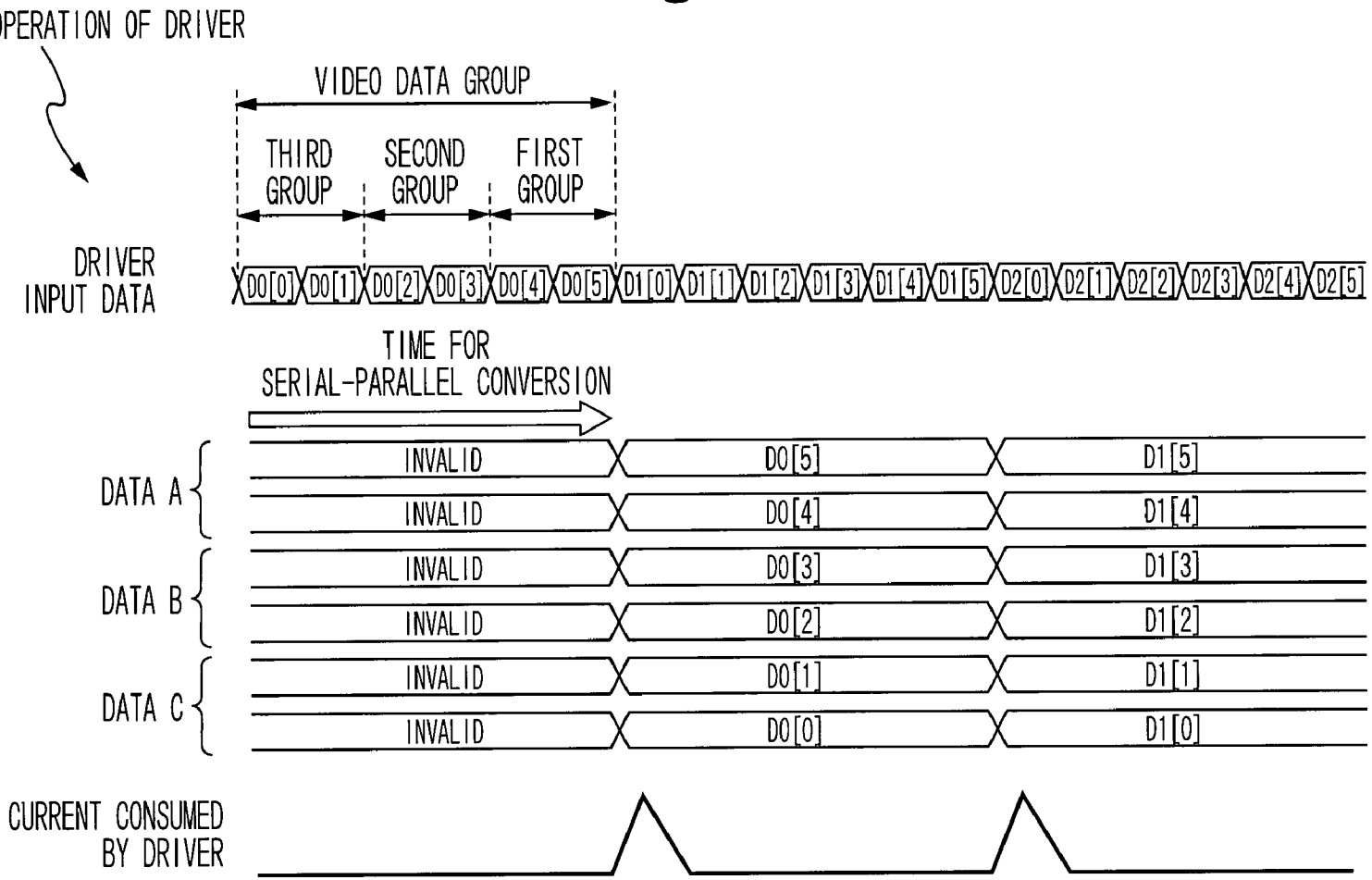
FIG. 6A is a timing chart for a case where the control circuit 20 is not provided in the signal driver 1.
Figure 6B:
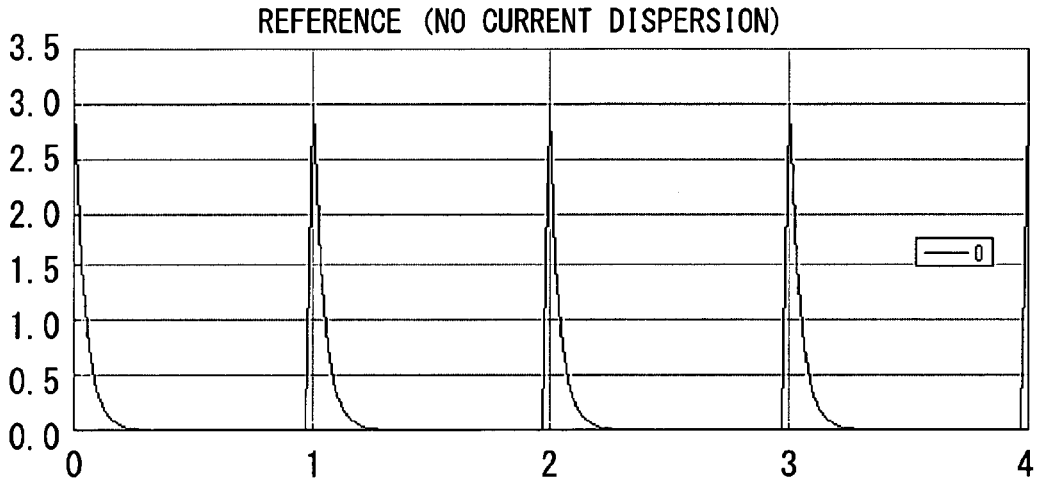
FIG. 6B is a graph showing a relationship between a horizontal period and a peak current indicating a peak value of a current consumed by the signal driver 1 in the case shown in FIG. 6A.
Figure 6C:
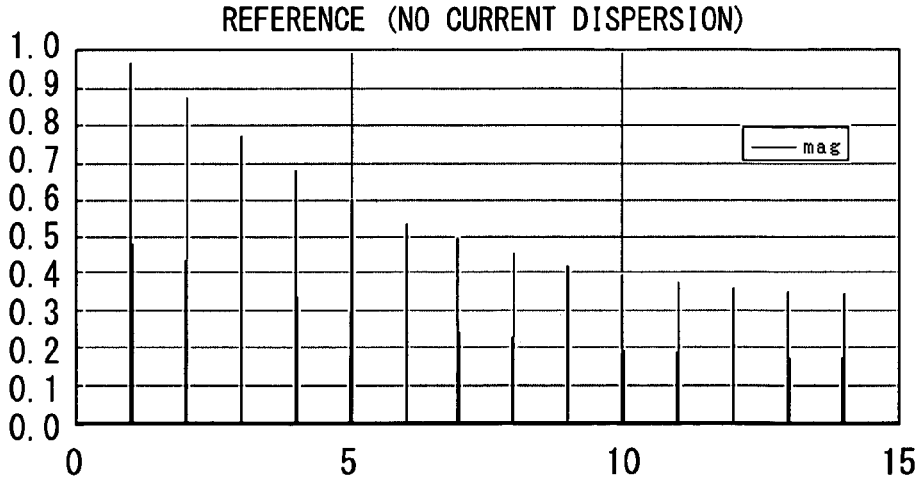
FIG. 6C is a graph showing a relationship between a frequency generated by the peak current shown in FIG. 6B and a frequency component obtained by normalizing a component of the aforementioned frequency.

FIG. 6A is a timing chart for a case where the control circuit 20 is not provided in the signal driver 1. FIG. 6B is a graph showing a relationship between a horizontal period and a peak current indicating a peak value of a current consumed by the signal driver 1 in the case shown in FIG. 6A. FIG. 6C is a graph showing a relationship between a frequency generated by the peak current shown in FIG. 6B and a frequency component obtained by normalizing a component of the aforementioned frequency.

In this case, as shown in FIG. 6A, the drive circuit 30 in the signal driver 1 outputs the sorted video data group A, the sorted video data group B, and the sorted video data group C to the first sorted signal line group, the second sorted signal line group, and the third sorted signal line group, respectively. At this time, the sorted video data group A, the sorted video data group B, and the sorted video data group C are simultaneously outputted from the output amplifier circuit 17 of the drive circuit 30. However, the output amplifier circuit 17 has a high output current capability, and thus when a level of a signal indicating the video data is inverted from high to low or from low to high, a transient current (peak current) instantaneously flows into the signal lines. Due to the simultaneous inversion of the signal indicating the video data, the simultaneous flow of the peak current into the signal line group causes a large noise. Here in (processing 0), as shown in FIG. 6B, the peak current value is 3 (unit is omitted).

(Processing 1)

Figure 7A:
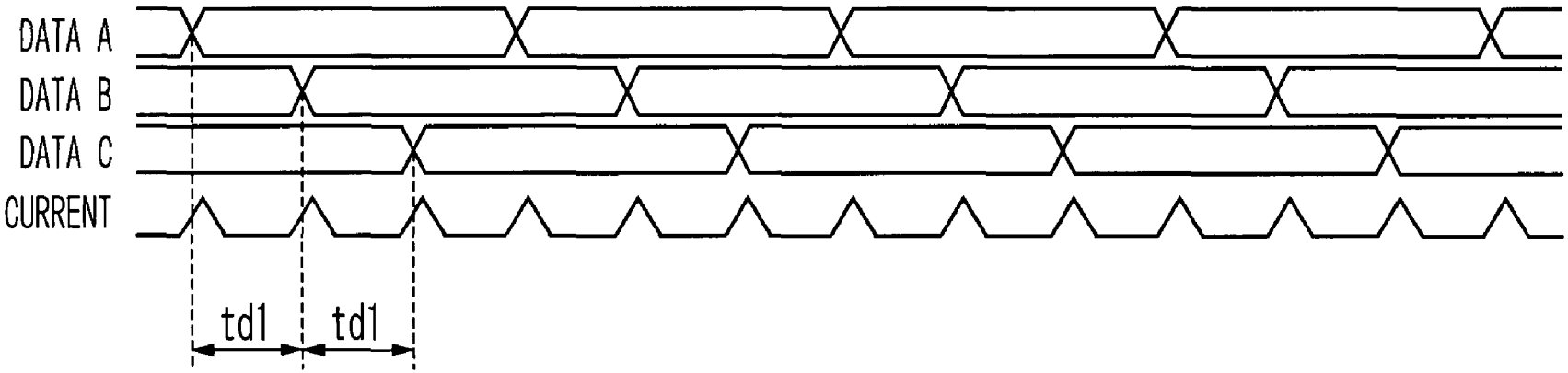
FIG. 7A is a timing chart for a case where the control circuit 20 is provided in the signal driver 1 and is provided with a first predetermined time td1 as a predetermined time td.
Figure 7B:
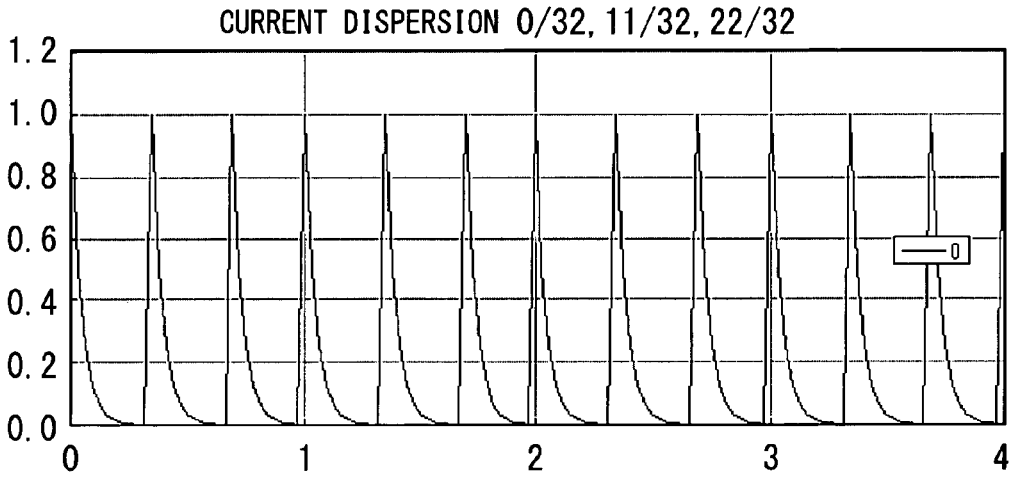
FIG. 7B is a graph showing a relationship between a horizontal period and a peak current indicating a peak value of a current consumed by the signal driver 1 in the case shown in FIG. 7A.
Figure 7C:
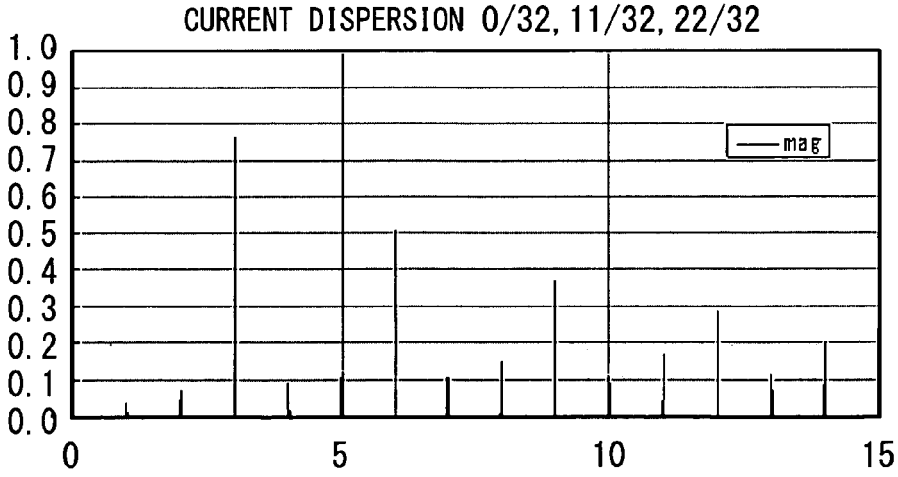
FIG. 7C is a graph showing a relationship between a frequency generated by the peak current shown in FIG. 7B and a frequency component obtained by normalizing a component of the aforementioned frequency.

FIG. 7A is a timing chart for a case where the control circuit 20 is provided in the signal driver 1 and is provided with a first predetermined time td1 as the predetermined time td. FIG. 7B is a graph showing a relationship between a horizontal period and a peak current indicating a peak value of a current consumed by the signal driver 1 in the case shown in FIG. 7A. This FIG. 7B indicates that when a single horizontal period is defined as T and this T is divided into 32, the sorted video data group A is outputted at timing (0/32) T, the sorted video data group B is outputted at (11/32) T as the first predetermined time td1, and then the sorted video data group C is outputted at timing (22/32) T as the next first predetermined time td1. FIG. 7C is a graph showing a relationship between a frequency generated by the peak current shown in FIG. 7B and a frequency component obtained by normalizing a component of the aforementioned frequency.

As shown in FIG. 7A, the control circuit 20 in the signal driver 1, in a single horizontal period, outputs the sorted video data group A, the sorted video data group B, and the sorted video data group C to the drive circuit 30 at timings respectively, each timing is shifted from the adjacent timing by the predetermined time td1. That is, in a single horizontal period, first, the control circuit 20 outputs the sorted video data group A to the drive circuit 30 at the first timing. Then, the control circuit 20 outputs the sorted video data group B to the drive circuit 30 at the second timing, the second timing is shifted from the first timing by the predetermined time td1. After that, the control circuit 20 outputs the sorted video data group C to the drive circuit 30 at the third timing, the third timing is shifted from the second timing by the predetermined time td1. In this case, the drive circuit 30, in a single horizontal period, outputs the sorted video data group A, the sorted video data group B, and the sorted video data group C from the control circuit 20 to the first sorted signal line group, the second sorted signal line group, and the third sorted signal line group, respectively. At this time, the sorted video data group A, the sorted video data group B, and the sorted video data group C are outputted from the output amplifier circuit 17 of the drive circuit 30 at timings respectively, each timing is shifted from the adjacent timing by the predetermined time td1. Here, in the (processing 1), as shown in FIG. 7B, the peak current value is 1 (unit is omitted). That is, in the (processing 1), relative to the aforementioned (processing 0), the peak current value decreases to one-third. Moreover, as shown in FIG. 7C, there is no difference between the frequency in the (processing 1) and the frequency in the (processing 0), but the frequency component in the (processing 1) is smaller than the frequency component in the (processing 0).

(Processing 2)

Figure 8A:
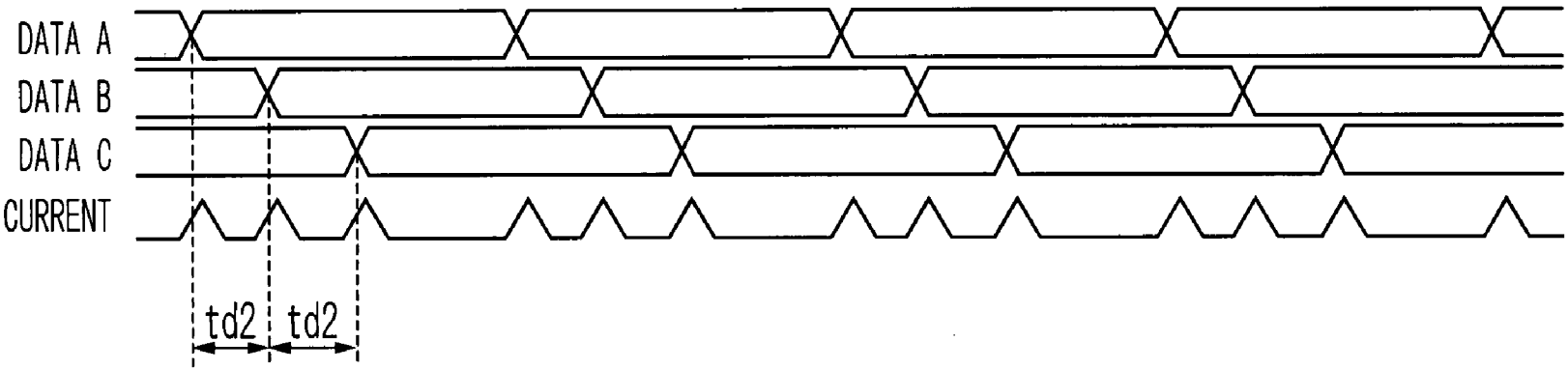
FIG. 8A is a timing chart for a case where the control circuit 20 is provided in the signal driver 1 and is provided with a second predetermined time td2 as the predetermined time td.
Figure 8B:
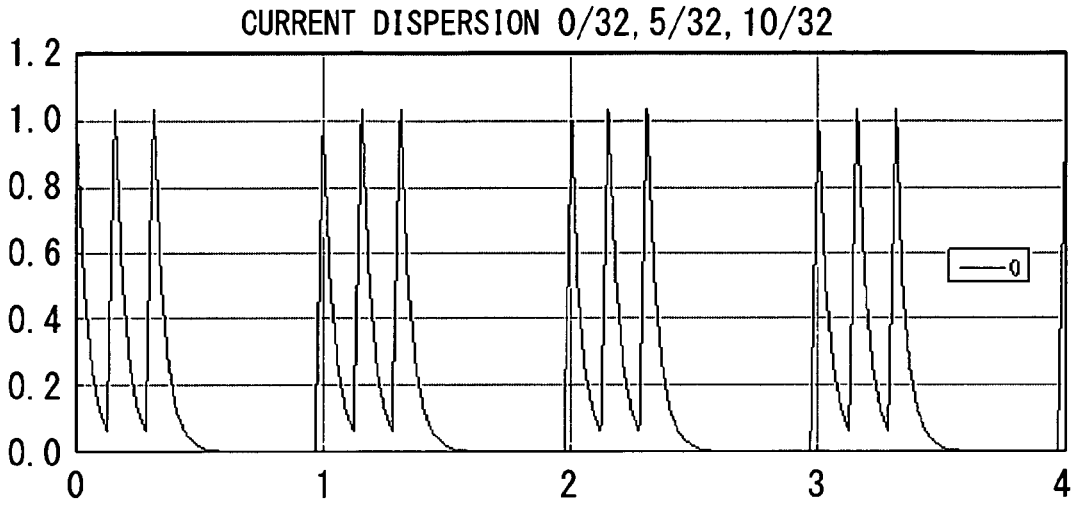
FIG. 8B is a view showing a relationship between a horizontal period and a peak current indicating a peak value of a current consumed by the signal driver 1 in the case shown in FIG. 8A.
Figure 8C:
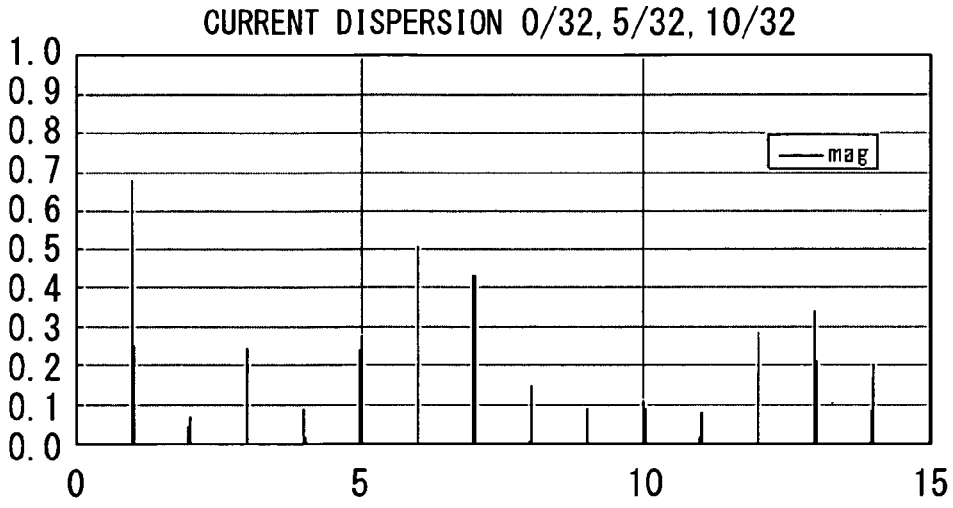
FIG. 8C is a view showing a relationship between a frequency generated by the peak current shown in FIG. 8B and a frequency component obtained by normalizing a component of the aforementioned frequency.

FIG. 8A is a timing chart for a case where the control circuit 20 is provided in the signal driver 1 and is provided with second predetermined time td2 as the predetermined time td. FIG. 8B is a view showing a relationship between a horizontal period and the peak current indicating the peak value of the current consumed by the signal driver 1 in the case shown in FIG. 8A. This FIG. 8B indicates that when a single horizontal period is defined as T and this T is divided into 32, the sorted video data group A is outputted at timing (0/32) T, the sorted video data group B is outputted at timing (5/32) T as the second predetermined time td2, and then the sorted video data group C is outputted at timing (10/32) T as the next second predetermined time td2. FIG. 8C is a view showing a relationship between a frequency generated by the peak current shown in FIG. 8B and a frequency component obtained by normalizing a component of the aforementioned frequency. The second predetermined time td2 is different from the first predetermined time td1 and for example, is shorter than the first predetermined time td1.

As shown in FIG. 8A, the control circuit 20 in the signal driver 1, in a single horizontal period, outputs the sorted video data group A, the sorted video data group B, and the sorted video data group C to the drive circuit 30 at timings respectively, each timing is shifted from the adjacent timing by the predetermined time td2. In this case, the drive circuit 30, in a single horizontal period, outputs the sorted video data group A, the sorted video data group B, and the sorted video data group C from the control circuit 20 to the first sorted signal line group, the second sorted signal line group, and the third sorted signal line group, respectively. At this time, the sorted video data group A, the sorted video data group B, and the sorted video data group C are outputted from the output amplifier circuit 17 of the drive circuit 30 at timings respectively, each timing is shifted from the adjacent timing by the predetermined time td2. Here, as shown in FIG. 8B, the peak current value is 1 (unit is omitted). That is, in the (processing 2), relative to the aforementioned (processing 0), the peak current value decreases to one-third. Moreover, as shown in FIG. 8C, there is no difference between the frequency in the (processing 2) and the frequency in the (processing 0), but the frequency component in the (processing 2) is smaller than the frequency component in the (processing 0). This frequency component is different from the frequency component in the (processing 1).

(Noise Reduction Processing)

Figure 9A:
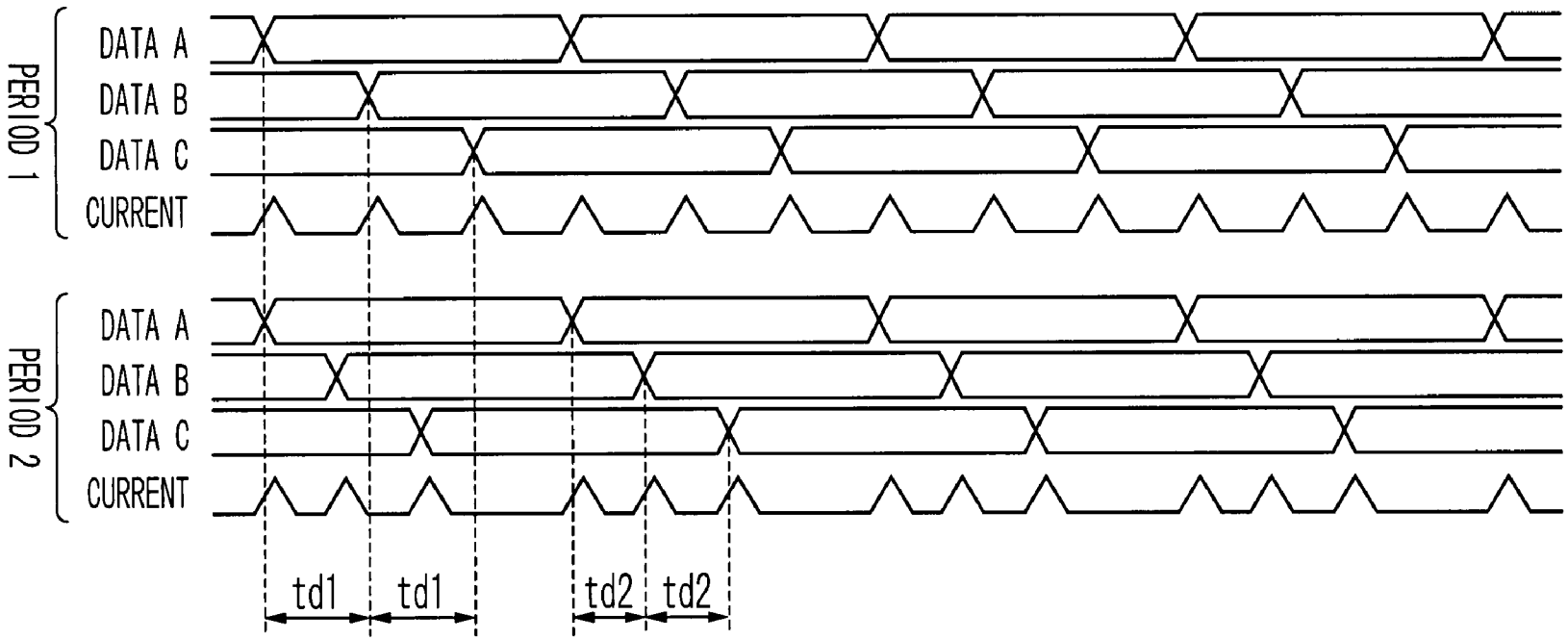
FIG. 9A is a timing chart for a case where the control circuit 20 is provided in the signal driver 1 and is provided with, for example, the first predetermined time td1 and the second predetermined time td2 alternately as the predetermined time td.
Figure 9B:
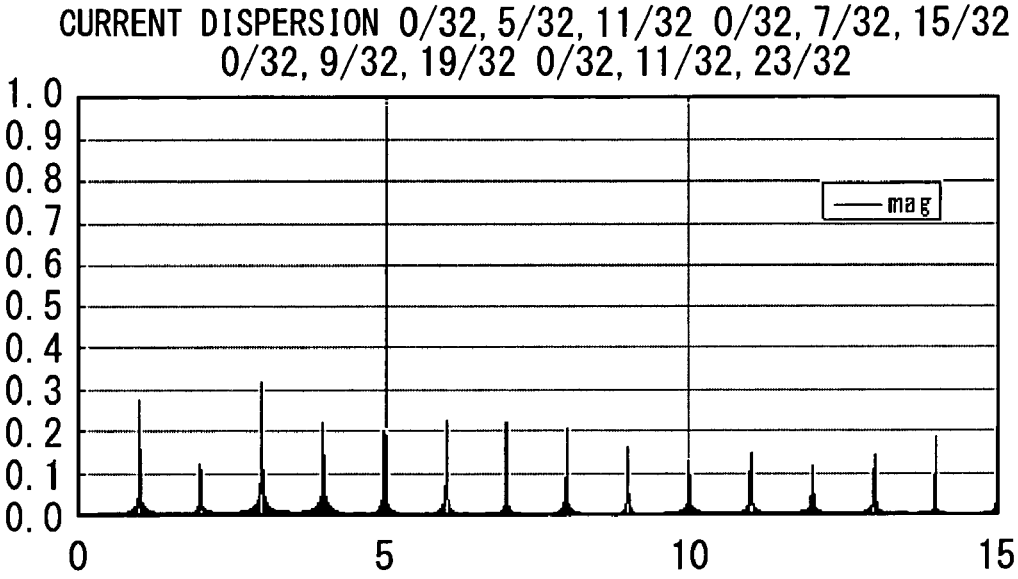
FIG. 9B is a view showing a relationship between a frequency generated by the peak current indicating a peak value of the current consumed by the signal driver 1 and a frequency component obtained by normalizing a component of the aforementioned frequency in the case shown in FIG. 9A.

FIG. 9A is a timing chart for a case where the control circuit 20 is provided in the signal driver 1 and is provided with, for example, the first predetermined time td1 and the second predetermined time td2 alternately as the predetermined time td. FIG. 9B is a view showing a relationship between a frequency generated by a peak current indicating a peak value of the current consumed by the signal driver 1 and a frequency component obtained by normalizing a component of the aforementioned frequency in the case shown in FIG. 9A.

This FIG. 9B indicates that when a single horizontal period is defined as T and this T is divided into 32, the sorted video data group A, the sorted video data group B, and the sorted video data group C are outputted at four types of timing.

For example, in the first type, the aforementioned (processing 1) is executed, the sorted video data group A is outputted at timing (0/32) T, the sorted video data group B is outputted at timing (5/32) T as the first predetermined time td1, and then the sorted video data group C is outputted at timing (11/32) T as the next first predetermined time td1.

In the second type, the aforementioned (processing 2) is executed, the sorted video data group A is outputted at timing (0/32) T, the sorted video data group B is outputted at timing (7/32) T as the second predetermined time td2, and then the sorted video data group C is outputted at timing (15/32) T as the next second predetermined time td2.

At the third type, the aforementioned (processing 1) is executed, the sorted video data group A is outputted at timing (0/32) T, the sorted video data group B is outputted at timing (9/32) T as the first predetermined time td1, and then the sorted video data group C is outputted at timing (19/32) T as the next first predetermined time td1.

At the fourth type, the aforementioned (processing 2) is executed, the sorted video data group A is outputted at timing (0/32) T, the sorted video data group B is outputted at timing (11/32) T as the second predetermined time td2, and then the sorted video data group C is outputted at timing (23/32) T as the next second predetermined time td2.

The control circuit 20, as described above, executes noise reduction processing that repeats the (processing 1) and the (processing 2). Specifically, in a first horizontal period, the delay control circuit 23 notifies the first predetermined time td1 as the predetermined time td to the control circuit 20. In a next second horizontal period following the first horizontal period, the delay control circuit 23 notifies the second predetermined time td2, which is different from the first predetermined time td1, as the predetermined time td to the control circuit 20.

In this case, as shown in FIG. 9A, the control circuit 20, in a single horizontal period, outputs the sorted video data group A, the sorted video data group B, and the sorted video data group C to the drive circuit 30 at timings respectively, each timing is shifted from the adjacent timing by the predetermined time td 1. At this time, the sorted video data group A, the sorted video data group B, and the sorted video data group C are outputted from the output amplifier circuit 17 of the drive circuit 30 at timings respectively, each timing is shifted from the adjacent timing by the predetermined time td1. The control circuit 20, in a next single horizontal period, outputs the sorted video data group A, the sorted video data group B, and the sorted video data group C group to the drive circuit 30 at timings respectively, each timing is shifted from the adjacent timing by the predetermined time td2. At this time, the sorted video data group A, the sorted video data group B, and the sorted video data group C are outputted from the output amplifier circuit 17 of the drive circuit 30 at timings respectively, each timing is shifted from the adjacent timing by the predetermined time td2. The control circuit 20 repeats the aforementioned (processing 1) and (processing 2) as the noise reduction processing and as a result, as shown in FIG. 9B, there is no difference between a frequency in the (noise reduction processing) and the frequencies in the (processing 1) and the (processing 2) but the frequency component in the (noise reduction processing) is much smaller than the frequency components in the (processing 1) and the (processing 2). That is, the control circuit 20 outputs the sorted video data group A, the sorted video data group B, and the sorted video data group C at the four types of timing, and as a result, the frequency component in the (noise reduction processing) is much smaller than the frequency components in the (processing 1) and the (processing 2).

As described above, the display device 10 according to the embodiment of the present invention outputs the video data in a single horizontal period to the signal lines at timings respectively, each timing is shifted from the adjacent timing by the predetermined time td (individually at intervals of the predetermined time td). At this time, the predetermined time td can be varied every horizontal period to thereby suppress an energy concentration on a specific frequency. Therefore, the display device 10 according to the embodiment of the present invention can keep noise, which is generated when the signal drivers 1 transfer the video data to the display panel 3, lower than conventional one.

Figure 10:
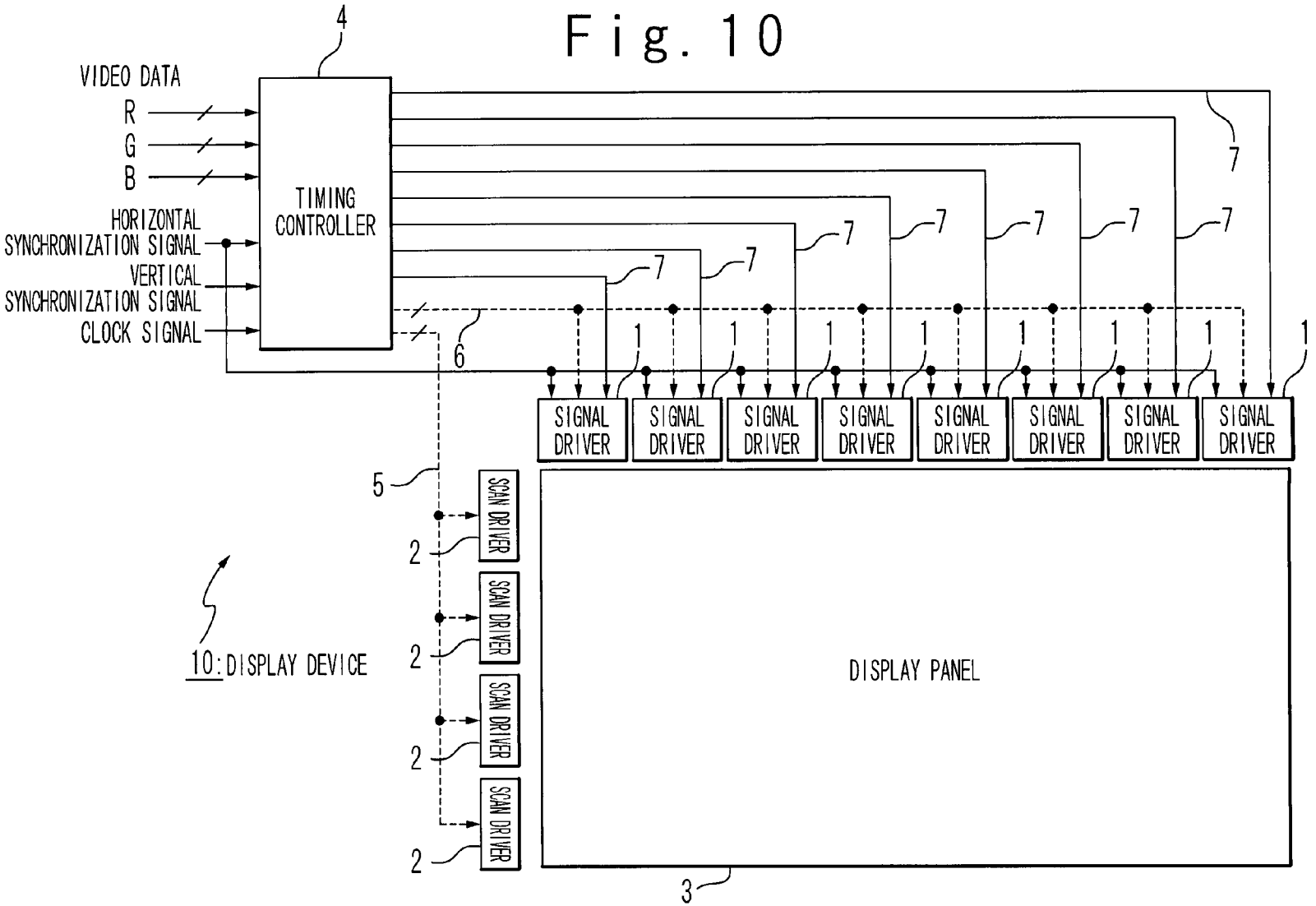
FIG. 10 is a view showing a configuration of the display device 10 according to another embodiment of the present invention.
Figure 11:
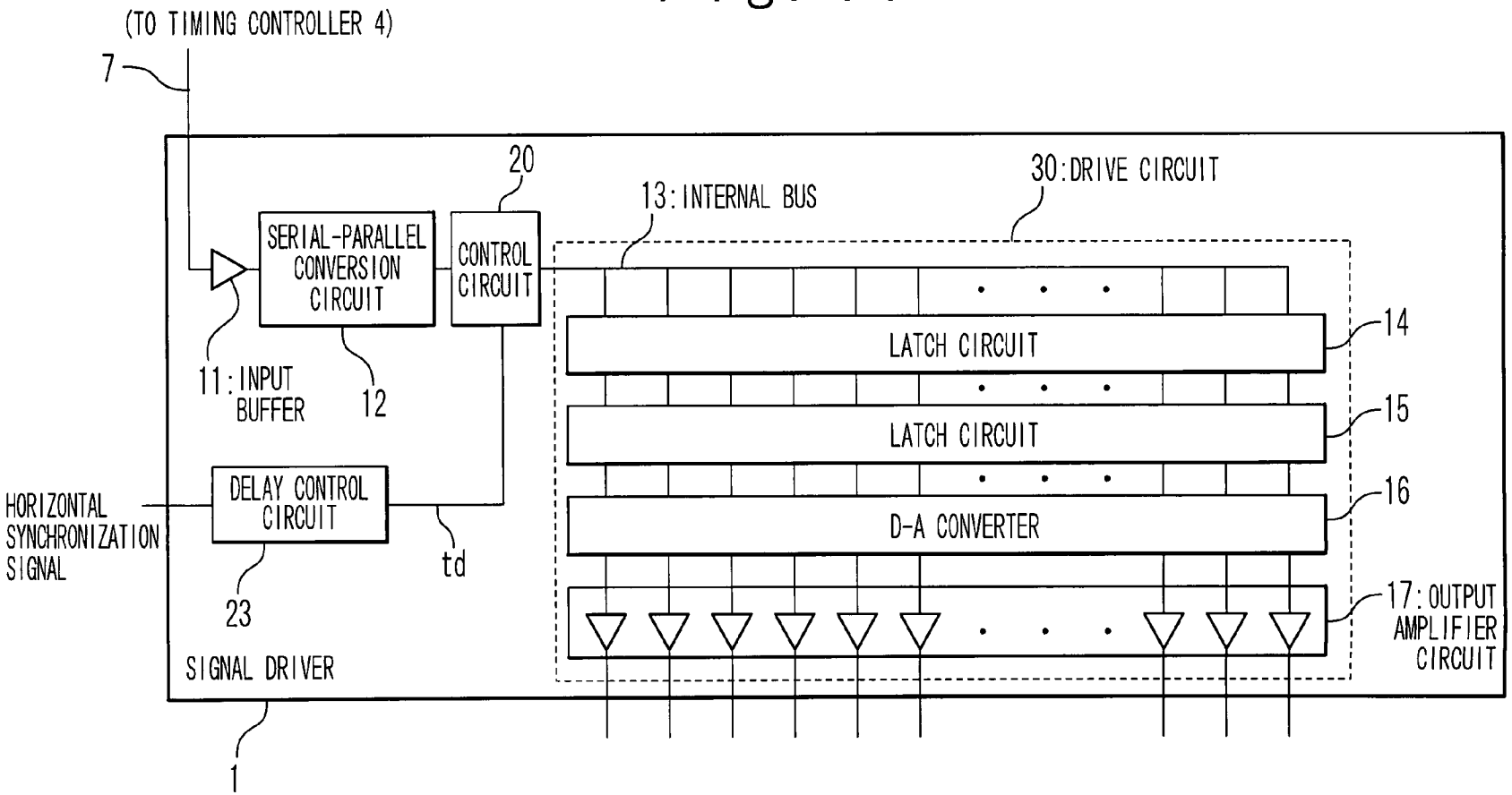
FIG. 11 is a view showing a configuration of the signal driver 1 of FIG. 10.

Note that the display device 10 according to the present invention may have the delay control circuit 23 provided in the signal driver 1, as shown in FIGS. 10 and 11.

FIG. 10 is a view showing a configuration of the display device 10 according to another embodiment of the present invention. The display device 10 according to this embodiment includes n signal drivers 1, m scan drivers 2, a display panel 3, and a timing controller 4.

FIG. 11 is a view showing a configuration of the signal driver 1 of FIG. 10. The signal driver 1 includes an input buffer 11, a serial-parallel conversion circuit 12, a control circuit 20, a drive circuit 30, and a delay control circuit 23.

The display device 10 including the signal driver 1 shown in FIGS. 10 and 11 is different from that shown in FIGS. 3 and 4, in that the delay control circuit 23 is provided in the signal driver 1. Since other configurations and operations are the same as those described in the above embodiment, their explanations are omitted. The similar effects can be obtained in the display device 10 shown in FIGS. 10 and 11.

It is apparent that the present invention is not limited to the above embodiment, but may be modified and changed without departing from the scope and spirit of the invention.

Although the present invention has been described above in connection with several exemplary embodiments thereof, it would be apparent to those skilled in the art that those exemplary embodiments are provided solely for illustrating the present invention, and should not be relied upon to construe the appended claims in a limiting sense.

What is claimed is:

1. A display device comprising:

a display portion configured to be connected to a plurality of signal line groups;

a signal driver configured to be connected to said plurality of signal line groups and output a plurality of video data groups to said plurality of signal line groups at timings respectively in a single horizontal period, each of said timings is shifted from an adjacent timing by a predetermined time; and a delay control circuit configured to vary said predetermined time every horizontal period and supply said predetermined time to said signal driver wherein said signal driver includes:

a delay circuit configured to output said plurality of video data groups at said timings respectively in said single horizontal period, said each timing is shifted from an adjacent timing by said predetermined time, and a drive circuit configured to output said plurality of video data groups from said delay circuit to said plurality of signal line groups respectively in said single horizontal period, wherein said plurality of signal line groups is sorted into N (N is a integer, equal to or more than 2) groups, and is connected to said signal driver and said display portion as N sorted signal line groups, wherein said signal driver further includes:

a division circuit configured to sort said plurality of video data groups into N groups to generate N sorted video data groups, wherein said delay circuit includes:

N delay portions configured to output said N sorted video data groups at said timings respectively in said single horizontal period, said each timing is shifted from an adjacent timing by said predetermined time, and wherein said drive circuit outputs said N sorted video data groups from said N delay portions to said N sorted signal line groups respectively in said single horizontal period.

2. The display device according to claim 1, wherein said drive circuit includes: a first latch circuit configured to store said plurality of video data groups from said delay circuit, a second latch circuit configured to store said plurality of video data groups stored by said first latch circuit in said single horizontal period, a digital-analog converter configured to perform an digital-analog conversion on said plurality of video data groups stored by said second latch circuit, and output a plurality of output voltage groups corresponding to said plurality of video data groups, and an output amplifier circuit configured to output said plurality of output voltage groups to said plurality of signal line groups respectively.

3. The display device according to claim 1, wherein said signal driver further includes:

an input circuit configured to receive display data to which said plurality of video data groups is serialized by the signal driver; and a serial-parallel conversion circuit configured to perform a serial-parallel conversion on said display data, and output said plurality of video data groups.

4. The display device according to claim 3, further comprising: a timing controller configured to transmit said display data to said signal driver.

5. The display device according to claim 1, wherein said delay control circuit supplies a first predetermined time as said predetermined time to said signal driver in a first horizontal period, and supplies a second predetermined time different from said first predetermined time as said predetermined time to said signal driver in a second horizontal period next to said first horizontal period.

6. The display device according to claim 1, wherein the signal driver is further configured to change the predetermined period in response to a control signal, and wherein the delay control circuit is configured to generate the control signal in response to a horizontal synchronization signal to vary the predetermined period every horizontal period.

7. A signal driver which is applied to a display portion connected to a plurality of signal line groups in a display device, comprising:

a delay circuit configured to output a plurality of video data groups at timings respectively in a single horizontal period, each of said timings is shifted from an adjacent timing by a predetermined time; and a drive circuit configured to output said plurality of video data groups from said delay circuit to said plurality of signal line groups respectively in said single horizontal period, wherein said predetermined time is varied every horizontal period wherein said plurality of signal line groups is sorted into N (N is a integer, equal to or more than 2) groups, and is connected to said signal driver and said display portion as N sorted signal line groups, wherein said signal driver further comprises: a division circuit configured to sort said plurality of video data groups into N groups to generate N sorted video data groups, wherein said delay circuit includes: N delay portions configured to output said N sorted video data groups at said timings respectively in said single horizontal period, said each timing is shifted from an adjacent timing by said predetermined time, and wherein said drive circuit outputs said N sorted video data groups from said N delay portions to said N sorted signal line groups respectively in said single horizontal period.

8. The signal driver according to claim 7, wherein said drive circuit includes: a first latch circuit configured to store said plurality of video data groups from said delay circuit, a second latch circuit configured to store said plurality of video data groups stored by said first latch circuit in said single horizontal period, a digital-analog converter configured to perform an digital-analog conversion on said plurality of video data groups stored by said second latch circuit, and output a plurality of output voltage groups corresponding to said plurality of video data groups, and an output amplifier circuit configured to output said plurality of output voltage groups to said plurality of signal line groups respectively.

9. The signal driver according to claim 7, further comprising:

an input circuit configured to receive display data to which said plurality of video data groups is serialized by the signal driver; and a serial-parallel conversion circuit configured to perform a serial-parallel conversion on said display data, and output said plurality of video data groups.

10. The signal driver according to claim 7, further comprising: a delay control circuit configured to vary said predetermined time every horizontal period and supply said predetermined time to said delay circuit.

11. The signal driver according to claim 10, wherein said delay control circuit supplies a first predetermined time as said predetermined time to said signal driver in a first horizontal period, and supplies a second predetermined time different from said first predetermined time as said predetermined time to said signal driver in a second horizontal period next to said first horizontal period.

12. The signal driver according to claim 7, wherein the delay circuit is further configured to change the predetermined period in response to a control signal.

13. A signal driver, comprising:

a delay circuit configured to output at least a first data group at a first timing and a second data group at a second timing, the second timing is delayed from the first timing for a predetermined period of time, wherein the delay circuit is further configured to change the predetermined period in response to a control signal; and a drive circuit configured to output the first and second data groups to a display panel, a division circuit configured to sort said plurality of video data groups into said first and second groups to generate first and second sorted video data groups, wherein said delay circuit includes:

first and second delay portions configured to output said first and second sorted video data groups at said timings respectively in said single horizontal period, said each timing is shifted from an adjacent timing by said predetermined time, and wherein said drive circuit outputs said first and second sorted video data groups from said first and second delay portions to said first and second sorted signal line groups respectively in said single horizontal period.

14. The signal driver according to claim 13, further comprising a delay control circuit configured to generate the control signal indicating the predetermined period in response to a horizontal synchronization signal to vary the predetermined period.

15. The signal driver according to claim 14, wherein the signal driver is configured to vary the predetermined period every horizontal period.

16. The signal driver according to claim 15, wherein the delay circuit is further configured to output a third data group at a third timing being delayed from the second timing for the predetermined period.

17. The signal driver according to claim 13, wherein the signal driver is configured to be coupled between a timing controller and the display panel to vary data timings to the display panel.

18. The signal driver according to claim 17, wherein the signal driver is configured to be varied to the predetermined period every horizontal period with the control signal indicating the predetermined period.

* * * * *